US005289078A

United States Patent [19]

Kitao et al.

[11] Patent Number: 5,289,078

[45] Date of Patent: Feb. 22, 1994

[54] ELECTRON SOURCE FOR A DISPLAY DEVICE

[75] Inventors: Satoshi Kitao, Kyoto; Kinzo Nonomura, Ikoma; Jumpei Hashiguchi, Neyagawa; Ryuichi Murai, Katano, all of Japan

[73] Assignee: Matsushita Electric Industrial Co., Ltd., Kadoma, Japan

[21] Appl. No.: 797,073

[22] Filed: Nov. 25, 1991

[30] Foreign Application Priority Data

Nov. 29, 1990 [JP] Japan ..... 2-333961

[51] Int. Cl.[5] ..... H01J 19/12

[52] U.S. Cl. ..... 313/310; 313/275; 313/279; 313/292; 313/308; 313/447; 313/457

[58] Field of Search ..... 313/447, 422, 451, 457, 313/279, 306, 308, 310, 269, 272, 275, 292

[56] References Cited

U.S. PATENT DOCUMENTS

| | | | |
|---|---|---|---|
| Re. 31,876 | 4/1985 | Watanabe et al. | 313/422 X |
| 4,804,887 | 2/1989 | Miyama et al. | 313/422 X |
| 4,887,000 | 12/1989 | Yamazaki et al. | 313/422 |

FOREIGN PATENT DOCUMENTS

| | | |
|---|---|---|
| 0391139 | 10/1990 | Fed. Rep. of Germany . |
| 60-112230 | 10/1985 | Japan . |
| 63-187538 | 8/1988 | Japan . |
| 2-33838 | 2/1990 | Japan . |

*Primary Examiner*—Donald J. Yusko
*Assistant Examiner*—Ashok Patel
*Attorney, Agent, or Firm*—Wenderoth, Lind & Ponack

[57] ABSTRACT

An electron source includes: linear thermionic cathodes for emitting electron beams; an electron beam lead-out electrode which is disposed substantially in a parallel relationship with the linear thermionic cathodes and is formed with apertures for passing the electron beams therethrough; and a plurality of support members for supporting the linear thermionic cathodes each of which has a contact portion held in contact with at least a portion of the linear thermionic cathodes; wherein each of the apertures of the elctron beam lead-out electrodes is disposed so as to confront the contact portion of the support member.

7 Claims, 4 Drawing Sheets

ELECTRON SOURCE FOR A DISPLAY DEVICE

BACKGROUND THE INVENTION

The present invention relates to an electron source of a display unit for use in a television receiver, a terminal display of a computer, etc.

Conventionally, in an electron source employing a linear thermionic cathode, there has been a drawback that the cathode itself is vibrated during drive of the electron source, thereby resulting in a variation of the quantity of emitted electron beams. In order to prevent vibrations of the cathode, Japanese Laid-Open Patent Publication Nos. 63-187538 (1988) and 2-33838 (1990) and U.S. Pat. No. 4,887,000 propose a countermeasure in which a support member having a contact portion held in contact with a portion of the cathode is provided.

One example of a known electron source employing a linear thermionic cathode is described with reference to FIG. 1, hereinbelow. In FIG. 1, a striped back signal electrode 32 is formed on an insulating substrate 31. A plurality of linear thermionic cathodes 33 are provided in a direction perpendicular to the face of the drawing sheet of FIG. 1 so as to intersect with the back signal electrode 32. A grid electrode 34 is provided above and substantially in parallel with the cathodes 33. In order to prevent vibrations of each of the cathodes 33, a cathode support means 36 which is obtained by forming holes on a flat plate is provided such that the holes confront the back signal electrode 32. Hence, in FIG. 1, the cathode support means 36 has a plurality of wall portions 36A. The cathode support means 36 is constituted by a metallic substrate 36*a* formed with the holes by etching or the like and a heat resistant insulating member 36*b* coated on the metallic substrate 36*a*. Meanwhile, the cathode 33 is strained so as to be lightly pressed against the cathode support means 36. Although not specifically shown, all the above mentioned components of the known electron source are enclosed in a vacuum vessel, The operation of the known electron source of the above described arrangement is described as follows. In FIG. 1, when a voltage which is positive relative to the cathode 33 is applied to the grid electrode 34 so as to heat the cathode 33 to temperatures enabling emission of electrons therefrom and a predetermined potential is imparted to the back signal electrode 32, the area in the vicinity of the cathode 33 corresponding to a portion of the back signal electrode 32 having the predetermined potential imparted thereto partially has an electric field in which electrons can be emitted from the cathode 33. As a result, an electron beam 35 is emitted from the cathode 33. The known electron source employing the linear thermionic cathode 33 described above is used for a picture display device disclosed in, for example, U.S. Pat. No. 31,876.

However, in the known electron source, surface of the insulating member 36*b* adjacent to its portion held in contact with the cathode 33 is electrically charged in a driving state of the cathode 33. Thus, even if a pair of neighboring sheet portions 32A of the back signal electrode 32, which interpose each of the wall portions 36A of the cathode support means 36, are set at a quite low potential, such a state is brought about in which electron beams are emitted at all times from portions of the cathode 33 held in contact with the cathode support means 36. Electron beams emitted from the portions of the cathode 33 held in contact with the cathode support member 36 pass partially, as leaked electron beams, through apertures of the grid electrode 34 as shown by the broken lines in FIG. 1. Accordingly, a switching voltage required for switching the electron beams on and off becomes extremely high.

In order to completely eliminate the leaked electron beams, a distance between the aperture of the grid electrode 34 and a portion of the insulating member 36*b* held in contact with the cathode 33, namely, actually a pitch of stripe of the back signal electrode 32 and a pitch of the apertures of the grid electrode 34 is required to be increased.

On the contrary, if electron beams should be finely controlled spatially without changing these pitches, it is impossible due to the leaked electron beams to create a state having no electron beam.

SUMMARY OF THE INVENTION

Accordingly, an essential object of the present invention is to provide, with a view to eliminating the above described inconveniences of the conventional electron sources, an electron source of relatively simple construction, in which emission of electron beams can be controlled at a relatively low switching voltage without changing a control pitch of the electron beams.

In order to accomplish this object of the present invention, an electron source embodying the present invention comprises: a linear thermionic cathode for emitting electron beams; an electrode which is disposed substantially in parallel with said linear thermionic cathode and is formed with an aperture for passing the electron beam therethrough; and a support means for supporting said linear thermionic cathode, which has a contact portion held in contact with at least a portion of said linear thermionic cathode; wherein the aperture of said electrode is so disposed as to confront said contact portion of said support means.

In the above described arrangement of the electron source, when a portion of the linear thermionic cathode is held in contact with the support means so as to correspond to one aperture of the grid electrode and is interposed by two neighboring portions of the linear thermionic cathode held in contact with the support means, electron beams are taken out mainly from vicinity of the portion of the linear thermionic cathode through the one aperture of the grid electrode. Therefore, since a distance between the one aperture of the grid electrode and each of the two neighboring portions of the linear thermionic cathode not confronting the one aperture is increased approximately to a control pitch of the electron beams as compared with that of prior art electron sources, the electron beams emitted from an electron beam emitting portion of the linear thermionic cathode, namely, from vicinity of the portion of the linear thermionic cathode held in contact with the support means pass through only the corresponding one aperture of the grid electrode.

Furthermore, since a control electrode for controlling the electron beams is formed integrally with the support means, the control electrode can be provided quite adjacent to the linear thermionic cathode and thus, a switching voltage for switching the electron beams on and off can be greatly reduced.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
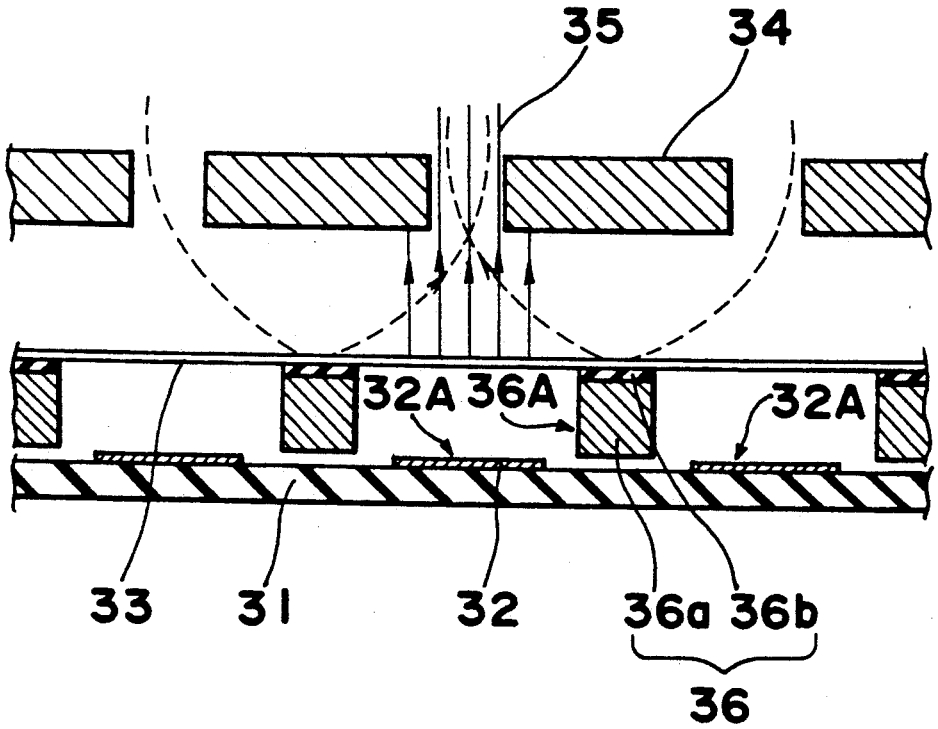
Fig. 1 PRIOR ART
FIG. 1 is a fragmentary sectional view of a prior art electron source (already referred to)

Referring now to the drawings, there is shown in FIG. 2, an electron source K according to one embodiment of the present invention. The electron source K includes a metallic substrate 1, a plurality of linear thermionic cathodes 3 for emitting electron beams, a striped cathode support means 2 for supporting the cathodes 3 and a grid electrode 4. The cathodes 3 are provided so as to intersect with the cathode support means 2. The cathode support means 2 is provided on the substrate 1, while the grid electrode 4 is provided above and substantially in parallel with the cathodes 3.

The cathode support means 2 is provided between the substrate 1 and the cathodes 3 so as to prevent vibrations of the cathodes 3. The cathode support means 2 includes a striped metallic element 2*a* and a heat resistant insulating member 2*b*. By deposition, frame spraying, etc., the insulating member 2*b* having a width several times a thickness of the cathodes 3 is formed on the substrate 2*a*, at such portions of the striped metallic element 2*a* as to be brought into contact with the cathodes 3.

Figure 3:
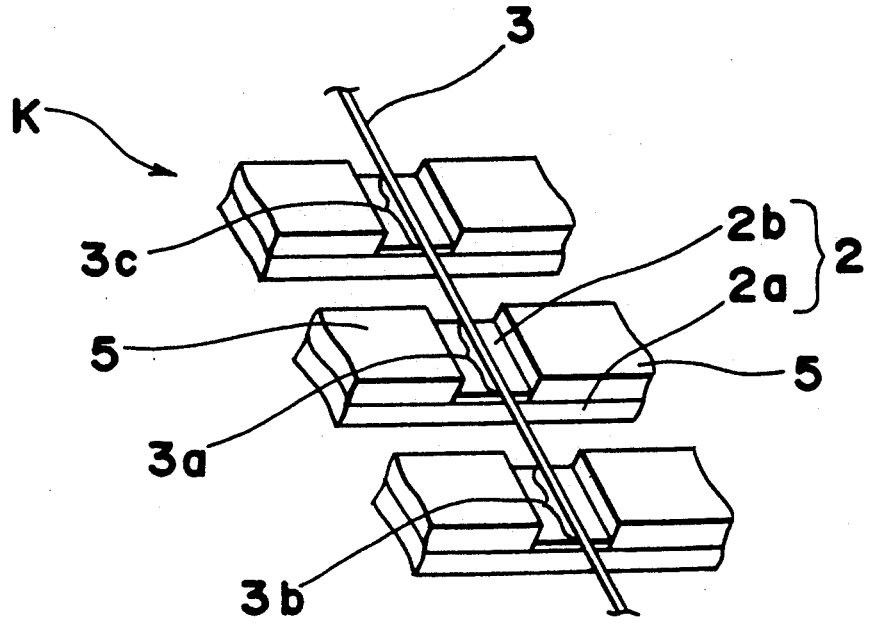
FIG. 3 is a perspective view showing a cathode support means employed in the electron source of FIG. 2.

Furthermore, a signal electrode 5 for controlling the electron beam emitted by the cathode 3 is provided in the vicinity of the cathode 3 as shown in FIG. 3 showing only periphery of the cathode 3 and the cathode support means 2. In FIG. 3, the cathode 3 is strained so as to be lightly pressed against the insulating member 2*b*. The signal electrode 5 is formed on the striped metallic element 2*a* so as to interpose the insulating member 2*b* therebetween. In this embodiment, the signal electrode 5 is electrically connected to the metallic element 2*a*. Although not specifically shown, all the above mentioned components of the electron source K are enclosed in a vacuum vessel.

Figure 2A:
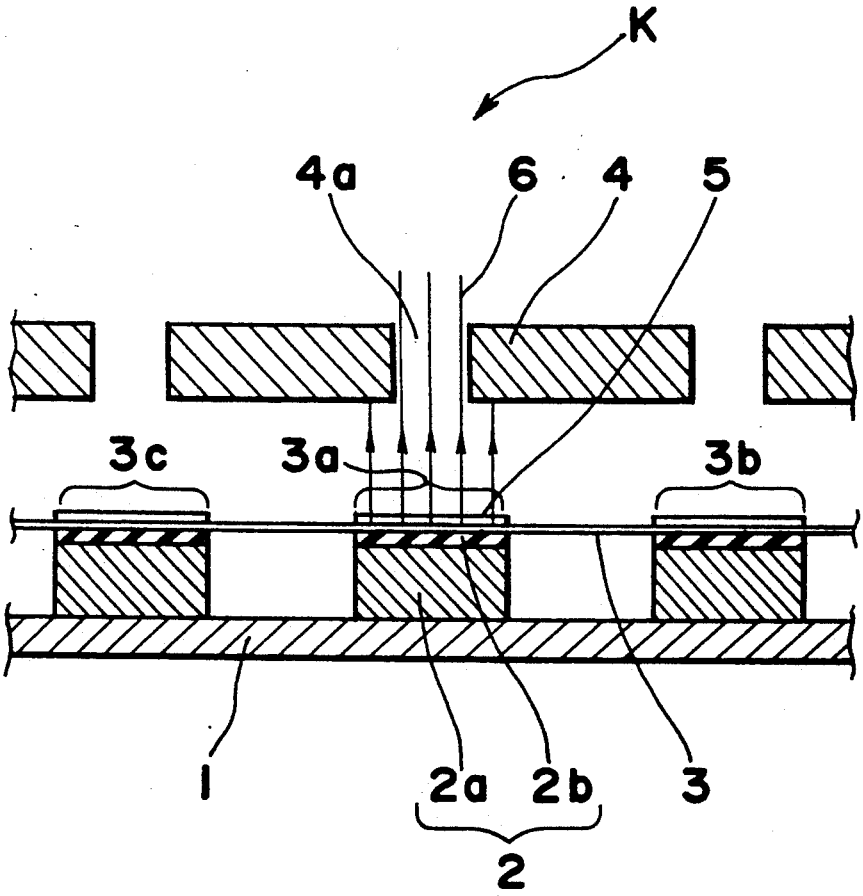
FIG. 2A is a fragmentary sectional view of an electron source according to one embodiment of the present invention.
Figure 2B:
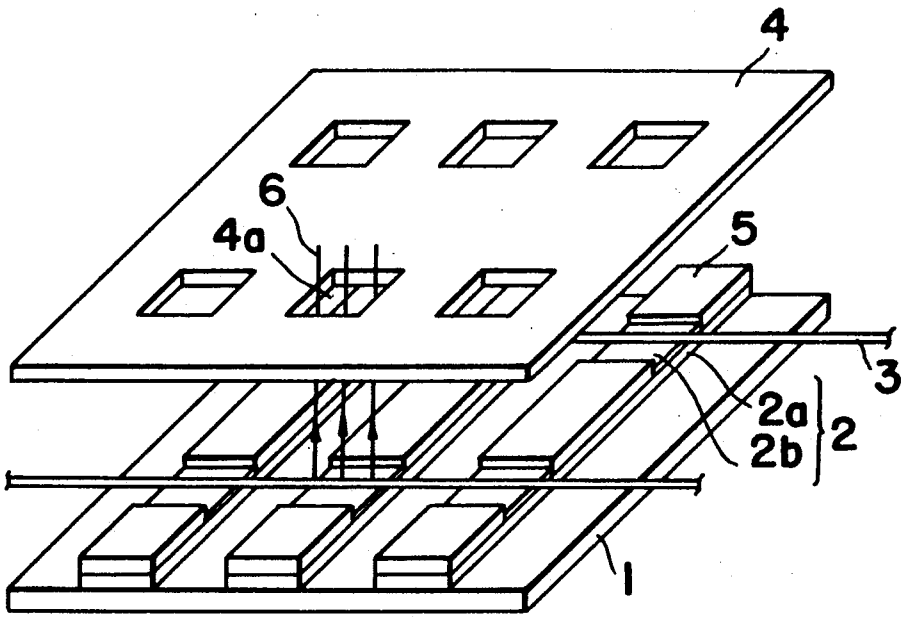
FIG. 2B is a perspective view of the electron source of FIG. 2A.

In FIG. 2B; the striped cathode support means 2 is formed on the substrate 1 and a plurality of the linear thermionic cathodes 3 are provided so as to intersect with the cathode support means 2. The latticed electron beam lead-out electrode 4 is provided above the linear thermionic cathodes 3.

By applying a voltage to the control electrode 5, the electron beam 6 is emitted from the cathode 3. In order to control the electron beam 6 for each of the cathodes 3, various methods can be employed in which, for example, a voltage applied to each cathode 3 itself is controlled and the electron beam is selected after having been emitted from the electron source. If the former method is employed, the electron beam can be obtained from only aperture 4*a* as shown in FIG. 2B.

The operation of the electron source K of the above described arrangement is described hereinbelow. In FIG. 2A, when a voltage which is positive relative to the cathode 3 is applied to the grid electrode 4 so as to heat the cathode 3 to temperatures enabling emission of electrons therefrom and a predetermined potential is imparted to the signal electrode 5, the areas in the vicinity of the cathode 3 corresponding to a portion of the signal electrode 5 having the predetermined potential imparted thereto partially has an electric field in which electrons can be emitted from the cathode 3. As a result, an electron beam 6 is emitted from the cathode 3.

When a portion 3*a* of the cathode 3 is held in contact with the cathode support means 2 so as to correspond to one aperture 4*a* of the grid electrode 4 and is interposed by two neighboring portions 3*b* and 3*c* of the cathode 3 held in contact with the cathode support means 2, electron beams are taken out mainly from vicinity of the portion 3*a* of the cathode 3 through the one aperture 4*a* of the grid electrode 4. Therefore, since a distance between the one aperture 4*a* of the grid electrode 4 confronting the portion 3*a* of the cathode 3 and each of the two neighboring portions 3*b* and 3*c* of the cathode 3 not confronting the one aperture 4*a* is increased approximately to a control pitch of the electron beams as compared with that of prior art electron sources, the electron beams emitted from an electron beam emitting portion of the cathode 3, namely, from vicinity of the portion 3*a* of the cathode 3 held in contact with the cathode support means 2 pass through only the corresponding one aperture 4*a* of the grid electrode 4.

At this time, the area in the vicinity of a portion of the insulating member 2*b* held in contact with the cathode 3 is electrically charged to a potential approximately identical with that of the cathode 3. Thus, without influence exerted by the signal electrode 5, a state is brought about in which electron beams are emitted at all times. However, in this embodiment, since the signal electrode 5 for controlling electron beams is formed integrally with the cathode support means 2 in contrast with prior art electron sources, a distance between the cathode 3 and the signal electrode 5 is reduced greatly in comparison with prior art electron sources. Therefore, a switching voltage required for turning on and off electron beams can be significantly lowered.

Figure 4:
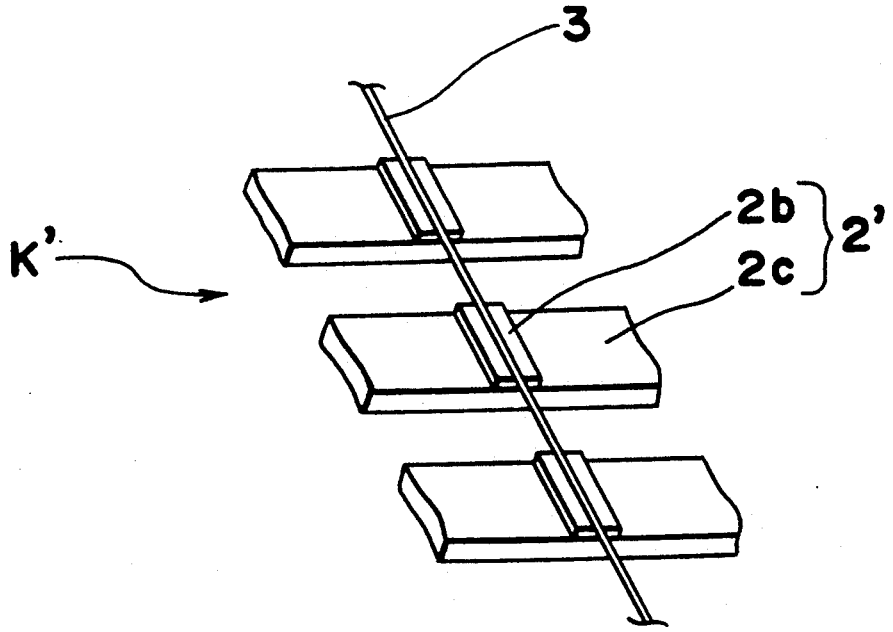
FIG. 4 is a view similar to FIG. 3, particularly showing a modification thereof.

FIG. 4 shows an electron source K' which is a modification of the electron source K. The modified electron source K' includes a cathode support means 2'. The cathode support means 2' includes a metallic element 2*c* acting also as the signal electrode 5 of the electron source K and a heat resistant insulating member 2*b* provided on the metallic element 2*c*. At a portion of the substrate 2*c*, which is brought into contact with the cathode 3, the insulating member 2*b* is so formed as to have a width smaller than that of the electron source K. Therefore, even if the signal electrode 5 is not provided separately, emission of electron beams from the cathode 3 can be controlled sufficiently by a potential applied to the metallic element 2*c*.

By this arrangement of the electron source K', the electron source K' is structurally simplified and its production cost can be lowered.

As is clear from the foregoing, the structure of the electron source of the present invention is made relatively simple. Furthermore, in accordance with the present invention, not only generation of leaked electron beams is substantially eliminated without increasing the control pitch of electron beams but emission of electron beams can be controlled at a relatively low switching voltage.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A thermionic electron source for a display device comprising:

a plurality of linear thermionic cathodes for emitting electron beams;

an electron beam take-out electrode which is disposed substantially in a parallel relationship with said linear thermionic cathodes; and a plurality of support means disposed in an X-Y matrix configuration with respect to said cathodes for supporting said linear thermionic cathodes, each of said support means having a contact portion held in contact with at least a respective portion of one of said linear thermionic cathodes;

wherein said electron beam take-out electrode is formed with apertures for passing the electron beams therethrough such that each of the apertures confronts a respective one of said contact portions of said support means; and wherein a plurality of control electrodes for controlling the electron beams emitted from said linear thermionic cathodes are formed integrally with said support means.

2. An electron source as claimed in claim 1, wherein each of said support means includes a metallic substrate and a heat resistant insulating member provided on said metallic substrate such that said metallic substrate is electrically insulated at least partially by said heat resistant insulating member.

3. An electron source as claimed in claim 2, wherein said metallic substrate of each of said support means acts also as an additional control electrode.

4. A thermionic electron source of a display device comprising:

a plurality of linear thermionic cathodes for emitting electron beams;

an electron beam take-out electrode which is disposed substantially in a parallel relationship with said linear thermionic cathodes and is formed with apertures for passing the electron beams therethrough;

a plurality of control electrodes, which are disposed adjacent to said linear thermionic cathodes, for controlling the electron beams emitted from said linear thermionic cathodes; and a plurality of support means disposed in an X-Y matrix configuration with respect to said cathodes for supporting said linear thermionic cathodes, each of said support means having a contact portion held in contact with at least a respective portion of one of said linear thermionic cathodes;

wherein each of the apertures of the electron beam take-out electrode is disposed so as to confront a respective one of said contact portions of said support means;

wherein said support means includes a metallic substrate and a heat resistance insulating member provided on said metallic substrate such that said metallic substrate is electrically insulated from said thermionic cathodes by means of said heat resistant insulating member.

5. A thermionic electron source of a display device comprising:

a plurality of linear thermionic cathodes for emitting electron beams;

an electron beam take-out electrode which is disposed substantially in a parallel relationship with said linear thermionic cathodes and is formed with apertures for passing the electron beams therethrough;

a plurality of control electrodes, which are disposed adjacent to said linear thermionic cathodes, for controlling the electron beams emitted from said linear thermionic cathodes; and a plurality of support means disposed in an X-Y matrix configuration with respect to said cathodes for supporting said linear thermionic cathodes, each of said support means having a contact portion held in contact with at least a respective portion of one of said linear thermionic cathodes;

wherein each of the apertures of the electron beam take-out electrode is disposed so as to confront a respective one of said contact portions of said support means; and wherein said control electrodes are formed integrally with said support means.

6. An electron source as claimed in claim 5, wherein each of said support means includes a metallic substrate and a heat resistant insulating member provided on said metallic substrate such that said metallic substrate is electrically insulated at least partially by said heat resistant insulating member.

7. An electron source as claimed in claim 6, wherein said metallic substrate of each of said support means acts also as an additional control electrode.

* * * * *